US008413401B2

(12) United States Patent
Wang

(10) Patent No.: US 8,413,401 B2
(45) Date of Patent: Apr. 9, 2013

(54) MODULAR DOOR CASE FOR BATHING ENCLOSURE

(75) Inventor: Chuan-Fu Wang, Taichung (TW)

(73) Assignee: Hou-Tzu Aluminum Co., Ltd., Taichung (TW)

( * ) Notice: Subject to any disclaimer, the term of this patent is extended or adjusted under 35 U.S.C. 154(b) by 94 days.

(21) Appl. No.: 13/189,748

(22) Filed: Jul. 25, 2011

(65) Prior Publication Data

US 2013/0025232 A1 Jan. 31, 2013

(51) Int. Cl.
*E04C 2/38* (2006.01)

(52) U.S. Cl. ..... 52/656.9; 52/656.4; 52/656.6

(58) Field of Classification Search ..... 52/204.1, 52/656.1, 656.2, 656.4, 656.6, 656.9; 4/557, 4/607, 609, 610
See application file for complete search history.

(56) References Cited

U.S. PATENT DOCUMENTS

| | | | | |
|---|---|---|---|---|
| 4,100,709 | A * | 7/1978 | Good | 52/239 |
| 5,205,102 | A * | 4/1993 | Plummer | 52/656.9 |
| 5,788,224 | A * | 8/1998 | Platt | 256/66 |
| 6,969,211 | B2 * | 11/2005 | Altman | 403/374.4 |
| 7,216,855 | B2 * | 5/2007 | Platt | 256/65.03 |
| 7,748,194 | B2 * | 7/2010 | Carless | 52/656.2 |
| 7,784,239 | B2 * | 8/2010 | Mansueto et al. | 52/656.9 |

* cited by examiner

*Primary Examiner* — Brian Glessner
*Assistant Examiner* — Adriana Figueroa

(57) ABSTRACT

A modular door case for bathing enclosure includes two jambs, two frame members, and four fasten components. Each frame member has an accommodating portion at ends thereof, and at least one pair clasp holes respectively formed on upper and lower walls of the accommodating portion. Each fasten component has a base, at least one pair of clasp members, and at least one compelling bolt. A clasp protrusion is disposed at opposite distal end of each clasp member, so that space between the pair of clasp members, in normal state, shrinks from the joint ends to the distal ones. Each clasp protrusion of the clasp member contacts each clasp hole of the frame member, while the base inserts into each accommodating portion. The compelling bolt is between the pair of the clasp members, and further capable of moving towards the distal ends of the clasp members.

20 Claims, 9 Drawing Sheets

MODULAR DOOR CASE FOR BATHING ENCLOSURE

BACKGROUND

1. Field of the Invention

The present invention relates generally to a shower room structure, and is more specifically concerned with a doorframe structure, which is easy to common user for assembling.

2. Background of the Invention

Conventional shower room door is designed for enclosing a bathtub or shower room to separate the dry zone from the wet one. Generally, it is assembled in advance by professionals, in which a whole doorframe is accomplished by screwing one rack to another. After the assembly, it is necessary to install the whole doorframe by the professionals in the spot field.

The conventional shower room door, to be honest, is substantially not designed well. The step of pre-assembly is insufficient of convenience because it is only met by specific persons, the professionals, but not by common users. Moreover, having the professionals to accomplish the whole installation of the doorframe may cost high and result in unexpected budget.

An improved shower room door offering convenient self-assembly and fast installation for common users should be targeted in the industry.

SUMMARY OF THE INVENTION

A primary object of the present invention is to provide a modular door case for bathing enclosure, which is benefit of convenient self-assembly for common users; the modular door case is simple structured and quick installed.

According to primary aspect of the present invention, a modular door case for bathing enclosure includes two jambs, a top frame member and a bottom frame member, and four fasten components. Each jamb defines a top end and a bottom end. Each frame member has an accommodating portion formed at each of two ends thereof, an upper wall and a lower wall confining the accommodating portion; and at least one pair clasp holes respectively formed on the upper and lower walls thereof. Each fasten component has a base, at least one pair of clasp members arranged above and below, and at least one compelling bolt penetrating the base to get between the pair of the clasp members. Each clasp member defines a joint end connected to the base, and a clasp protrusion disposed at a distal end thereof. Each clasp member is resilient enough to sway outwards, and the space between the two clasp protrusions at the distal ends, in normal state, is shorter than that between the two joint ends.

The bases of the four fasten components respectively connect to the top and bottom ends of the two jambs, and also insert into the accommodating portions of ends of the two frame members. The clasp protrusion of each clasp member contacts the corresponding clasp hole of each frame member, while the compelling bolt moves towards the distal ends of the corresponding clasp members. The clasp protrusion of each clasp member clips in the corresponding clasp hole of each frame member, so that the specific end of the frame member are tightened to the corresponding end of the jamb via one of the fasten components. The ends of each frame member respectively fasten to the ends of the two jambs thereby, and the modular door case for bathing enclosure is made.

BRIEF DESCRIPTION OF THE DRAWINGS

These objects and advantages of the present invention will be more readily apparent after consideration of the following description in conjunction with the drawings.

DETAILED DESCRIPTION OF PREFERRED EMBODIMENTS

Figure 1:
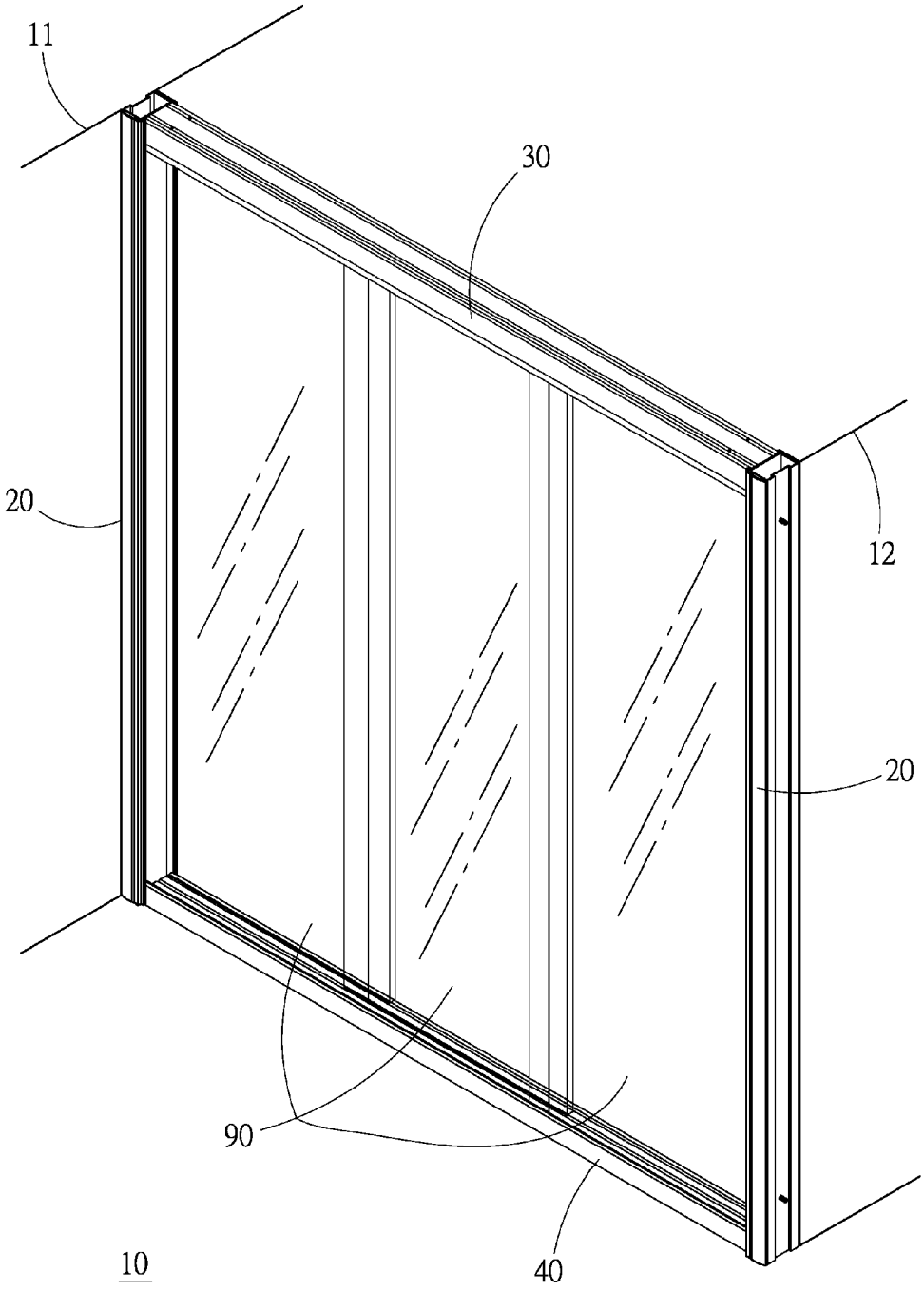
FIG. 1 is a perspective view illustrating a modular door case for bathing enclosure according to the present invention.
Figure 2:
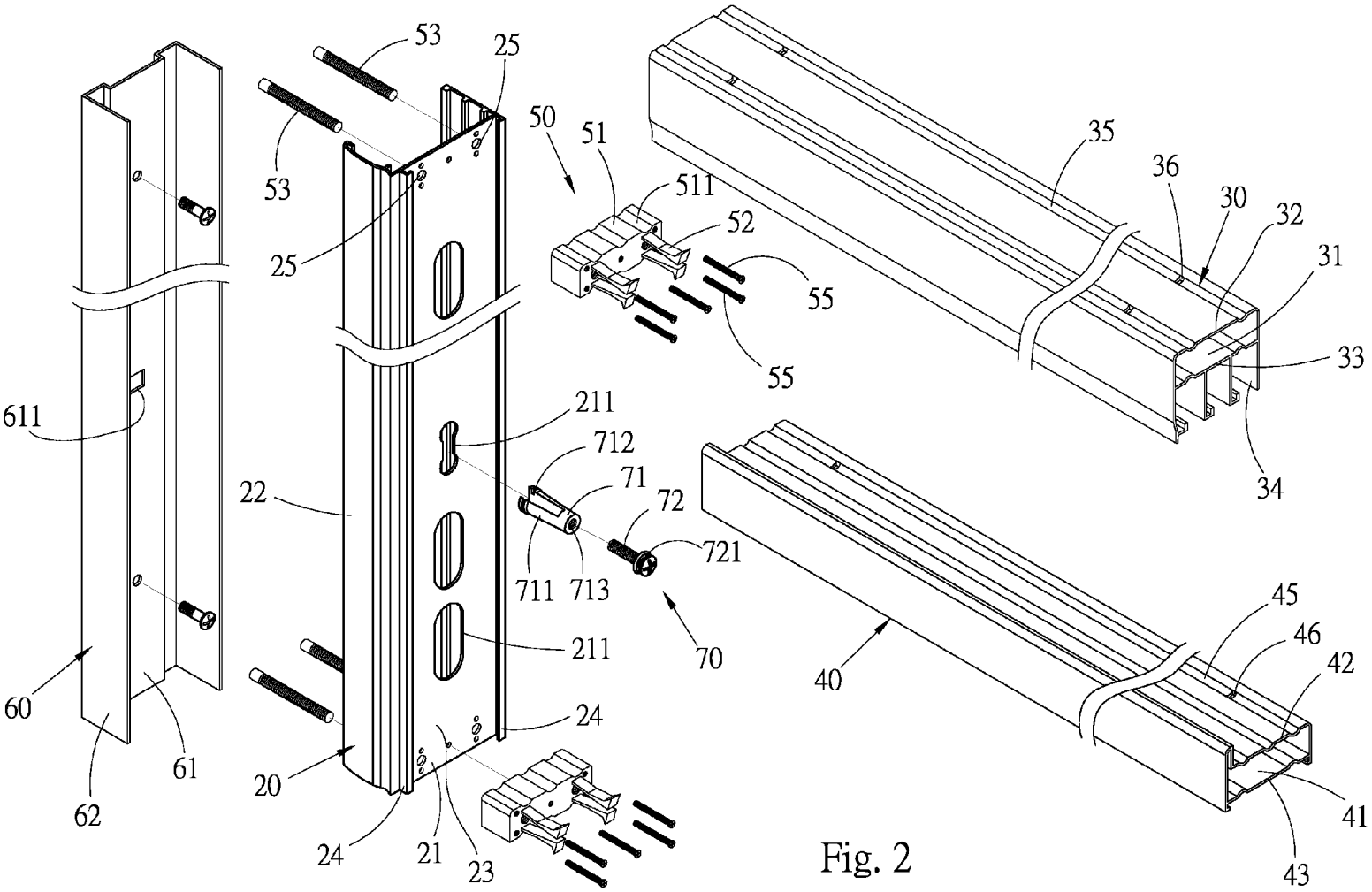
FIG. 2 is a partial decomposition view according to FIG. 1.

Certain embodiments as disclosed herein provide for a modular door case for bathing enclosure 10 of a preferred embodiment, as in FIGS. 1 and 2, wherein the modular door case 10 preferably spans between wall sides 11, 12 and is installed with several door sheets 90. The modular door case 10 includes two jambs 20, a top frame member 30 and a bottom frame member 40, and four fasten components 50, in which the fasten components 50 are used for connecting the top and bottom frame members 30, 40 to the two jambs 20 respectively.

Each jamb 20 is approximately of a U-shaped cross-sectional profile; and defines a top end and a bottom end. Two jambs 20 are set in symmetry. Each jamb 20 includes a connection board 21 and two sideboards 22. The two jambs 20 face to face by first faces of the connection boards 21 paralleling with each other. A limitation channel 23 is formed on the first face of the connection board 21 along the longitudinal direction of connection board 21, and two flanges 24 extending from two lateral sides of the first face of the connection board 21 are to define the limitation channel 23 together. Each connection board 21 of the jamb 20 has several slots 211 along a longitudinal direction of connection board 21. Two sideboards 22 extend from two lateral sides of a second face of the connection board 21.

The top frame member 30 has a first accommodating portion 31 formed at two ends thereof. The first accommodating portion 31 is confined by an upper wall 32 and a lower wall 33 of the top frame member 30 together. Several partitions 34 are connected below the lower wall 32 to respectively adapt for the door sheets 90. At least one groove 35 is formed on each wall 32, 33, and the groove 35 recesses toward the first accommodating portion 31 from each wall 32, 33. At least one pair of clasp holes 36 is formed respectively on the upper wall 32 and the lower wall 33 so as to align with each other. The pair of the clasp holes 36 is preferably arranged on the grooves 35 in a respective manner.

The bottom frame member 40 has a second accommodating portion 41 formed at two ends thereof. The second accommodating portion 41 is confined by an upper wall 42 and a lower wall 42 of the bottom frame member 40 together. At least one groove 45 is formed on each wall 42, 43, and the groove 45 recesses toward the first accommodating portion 31 from each wall 42, 43. At least one pair of clasp holes 46 is formed respectively on the upper wall 42 and the lower wall 43 so as to align with each other. The quantity of the grooves 45 is preferably as same as that of the partitions 34 for engaging with the door sheets 90 in a one-on-one manner. The pair of the clasp holes 45 according to this embodiment is arranged on the grooves 45 in a respective manner.

Figure 3:
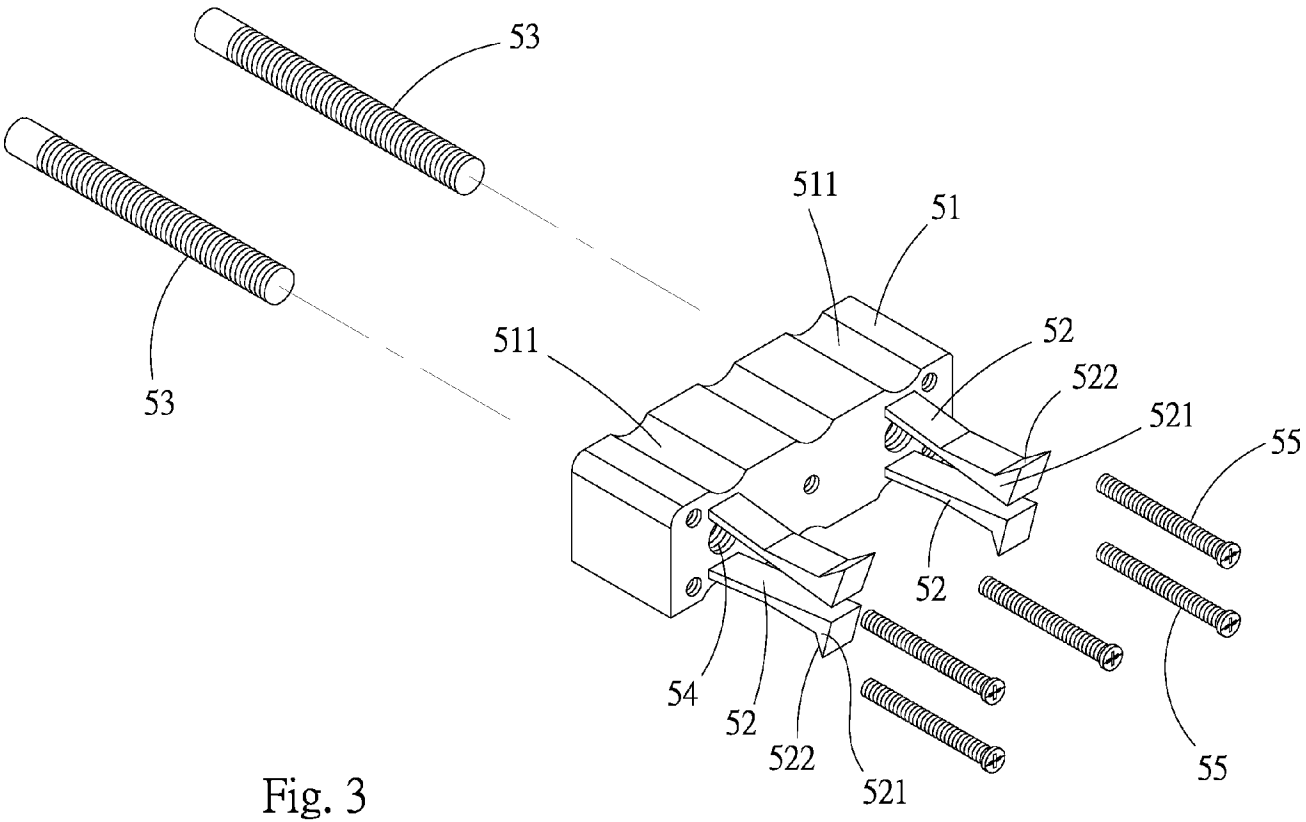
FIG. 3 is a decomposition view of a fasten component according to FIG. 1.
Figure 4:
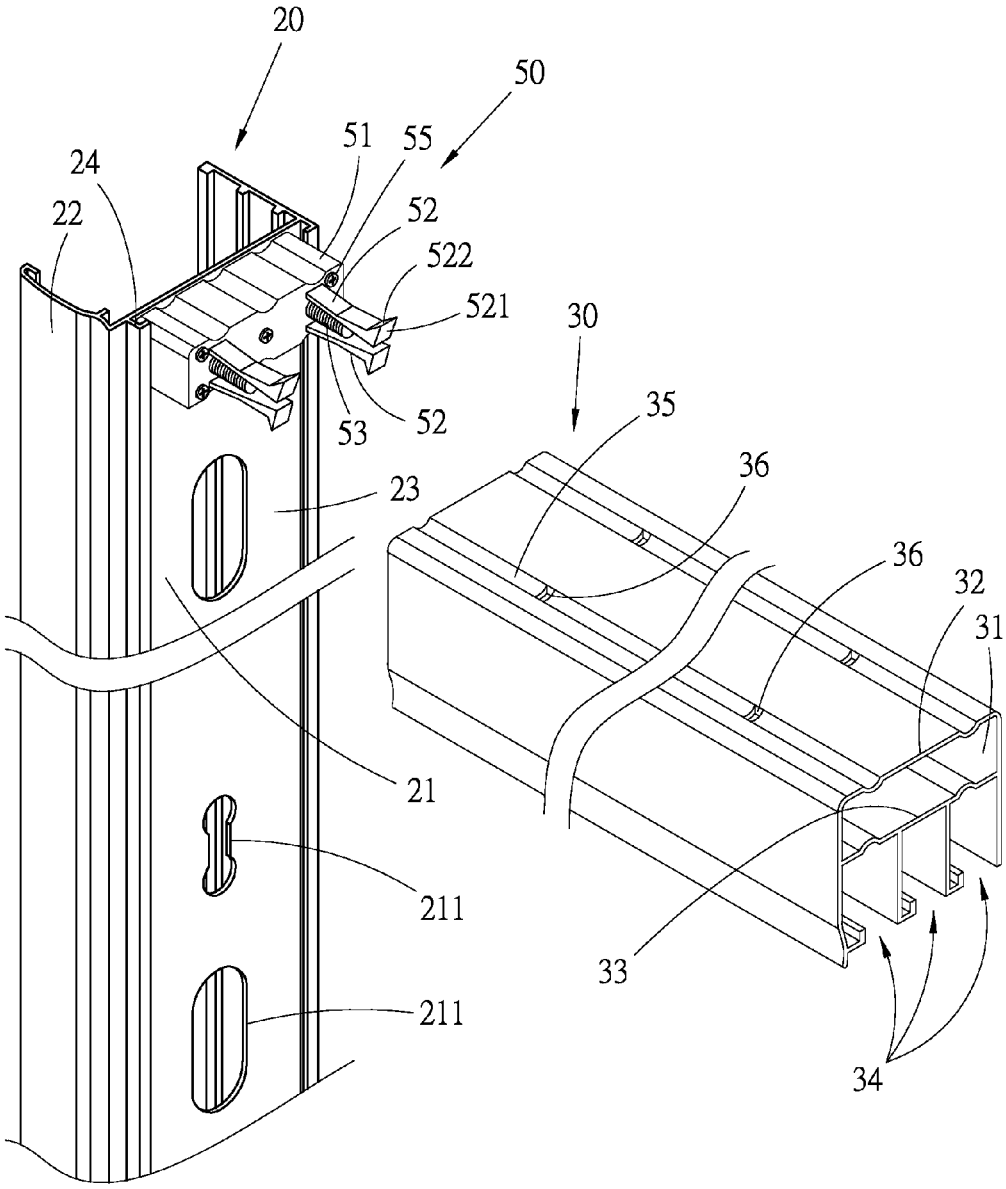
FIG. 4 is a decomposition view illustrating a top frame member assembling to a jamb according to the present invention.
Figure 5:
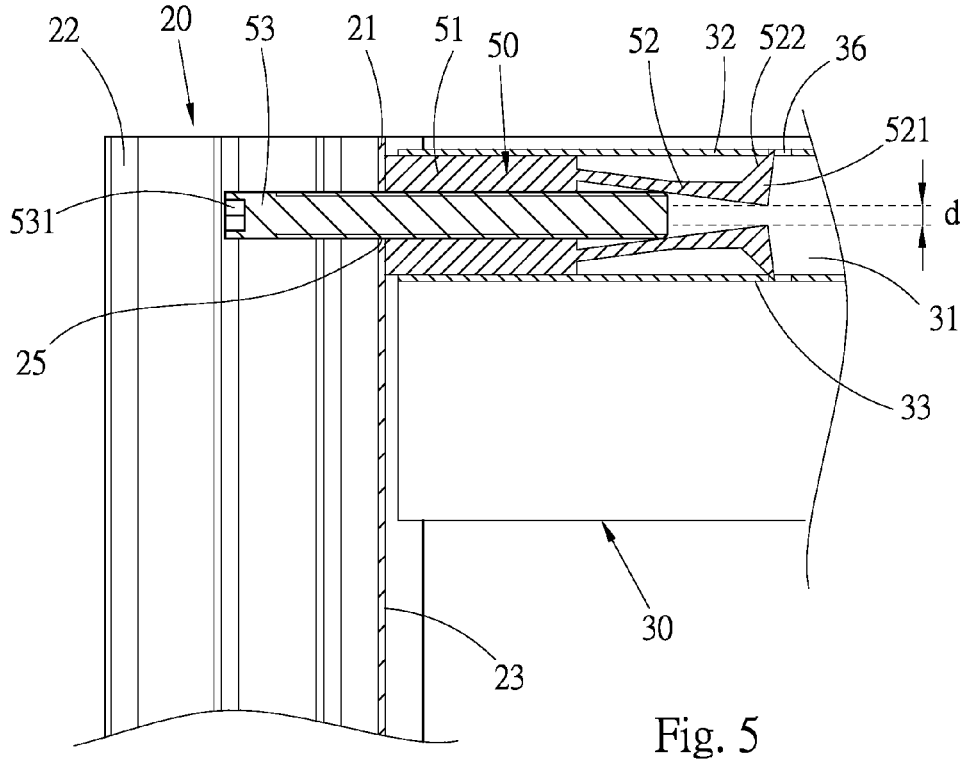
FIGS. 5 and 6 are cross-sectional profiles illustrating fasten component linking the top frame member to the jamb.
Figure 6:
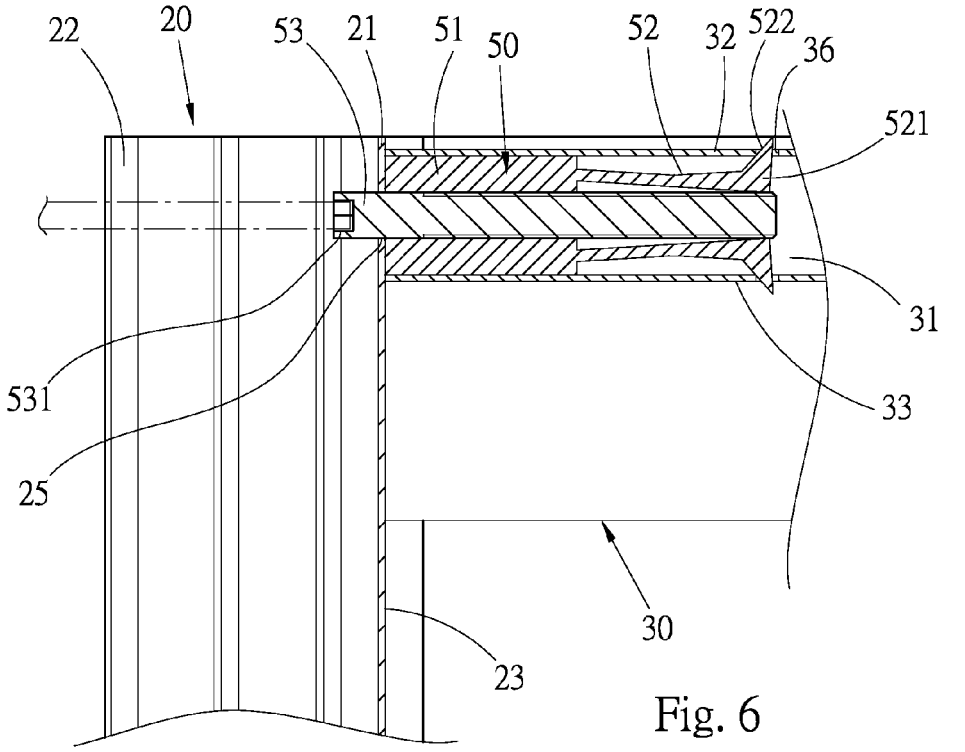

Referred in FIG. 3, each fasten component 50 has a base 51, at least one pair of clasp members 52, and at least one compelling bolt 53. The base 51 defines a first face and a second face opposite to each other, and at least one groove 511 formed on top and bottom faces thereof. The pair of the clasp members 52 defines a joint end connected to the first face of the base 51 and arranged above and below. Each clasp member 52 is resilient enough to sway outward. Each clasp member 52 defines a clasp protrusion 521 disposed at a distal end thereof, and each clasp protrusion 521 defines an inclination face 522, which is for abutting against the corresponding clasp hole 35 or 45 of the frame member 30 or 40. The space d between the two clasp protrusions 521 at the distal ends, in normal state, is shorter than space between the two joint ends thereof. The base 51 of each fasten component 50 has at least one threaded hole 54 between the pair of the clasp members 52, and the compelling bolt 53 is surrounded with threads. The compelling bolt 53 engages with the threaded hole 54 via an end thereof, and the other end thereof is formed with a hexangular hole 531. The compelling bolt 53 is capable of being driven to lead forwards and backwards, so that it can move further to get between the pair of the clasp members 52. The space d between the distal ends of the clasp members 52 is generally smaller than a diameter of the compelling bolt 53.

Figure 7:
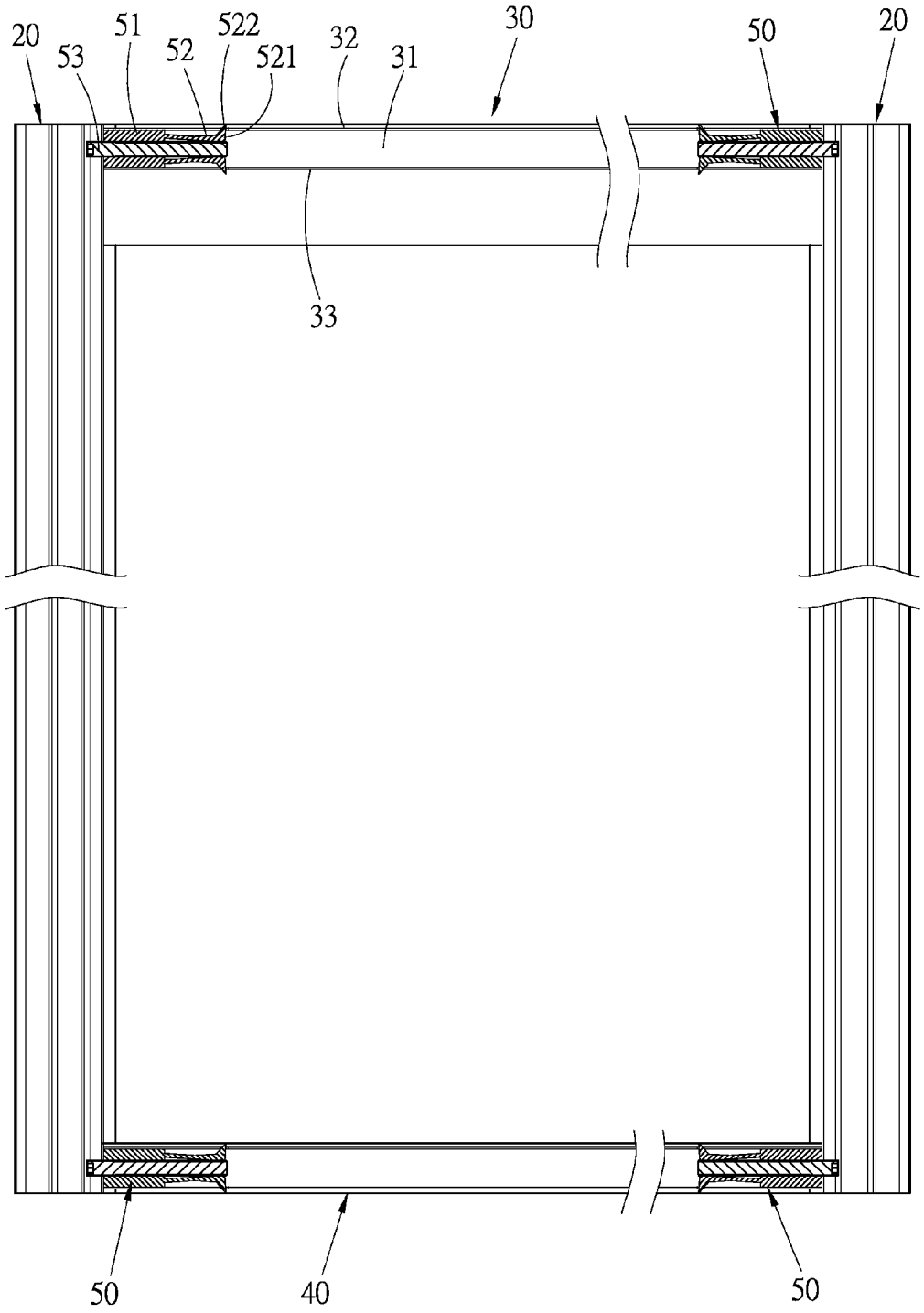
FIG. 7 is a sectional view of the modular door case for bathing enclosure according to the present invention.

Referred in FIGS. 4 to 7, it illustrates that the top frame member 30 is assembled to the top end of a respective one of jambs 20, and illustrates that two pairs of clasp members 52 of the base 50 correspond to the two pairs of the clasp holes 36 of the top frame member 30. To be detailed, two bases 51 of the respective two of the fasten components 50 is fixed to the first face of the connection board 21 of each jamb 20 by screws 55 in advance, and the two bases 51 are set in symmetry above and below. The compelling bolt 53 penetrates a through hole 25, which is preformed on the connection board 21 of each jamb 20, to screw with the threaded hole 54 of the base 50, and further lead to get between the pair of the clasp members 52 but without contacting the pair of the clasp members 52. At the mean time, the distal ends of the pair of the clasp members 52 still stay close. The fasten components 50 sit in each limitation channel 23 of the jambs 20. Two ends of the frame member 30, 40 align with top and bottom ends of the jambs 20. The bases 51 of each fasten component 50 sleeve into the each accommodating portion 31, 41 of each frame member 30, 40, while the groove 511 of the base 51 fits into the respective groove 35, 45 of each frame member 30, 40. The limitation channel 23 keeps each frame member 30, 40 from biasing. Referred in FIG. 5, after the base 51 inserts into each accommodating portion 31, 41, the clasp protrusions 521 of each clasp portion 52 contacts in the clasp holes 36, 46 of each frame member 30, 40 in a bevel manner. Then, to drive the compelling bolt 53 towards the distal ends of the clasp members 52, in order to shove the respective pair of the clasp members 52 outwards gradually. The clasp protrusions 521 of each clasp member clasp 52 clip in the corresponding pair of the clasp holes 36, 46 of each frame member 30, 40. When the clasp members 521 are shoved gradually, the clasp protrusions 521 gradually stretch in the corresponding clasp holes 36. Referred in FIG. 6, each clasp protrusion 521 of the clasp member 52 defines an inclination face 522 in order to abut against the corresponding one of the clasp holes 36, 46, while the clasp members 521 are shoved. The margin in each clasp hole 36, 46 will shrink as the process of the clasp members 521 are shoved, so that the top and bottom frame members 30, 40 respectively fasten to each ends of the two jambs 20, and the modular door case 10 in the present invention is created, as illustrated in FIG. 7.

When the clasp holes 36, 46 are formed on the grooves 35, 45, the clasp protrusions 521 reaches the clasp holes 36, 46 but not out of the upper and lower walls 32, 33, 42, 43, so as to keep a tidy appearance of the modular door case 10 and to prevent the modular door case 10 from obstruction while in assembly.

In addition, the modular door case 10 according to the present invention is of simple structure and easy assembly, so that the user could make it on his or her own. After accomplishing the assembly of the modular door case 10, the door sheets 90 are easily applied thereto. In a conclusion, the structure of the modular door case 10 according to the present invention is such simple for common user and there is no need to afford the budget of the professionals.

For meeting various spaces of the shower rooms or bathtubs, the modular door case 10 is further applied with two wall racks 60 in order to connect to the walls 11, 12. Each wall rack 60 includes a wall board 61, and two sideboards 62 extending from two lateral sides of a face of the wall board 61. The two wall racks 60 are sleeved into the two jambs 20 respectively, and the wall board 61 of each wall rack 60 and the connection board 21 of the corresponding jamb 20 face to each other. The wall board 61 of each wall rack 60 has at least one conjunction hole 611 along a longitudinal direction thereof. In this preferred embodiment, the conjunction hole 611 is approximately rectangular. At least one adjustment component 70 links the wall board 61 of each wall rack 60 to the connection board 21 of the corresponding jamb 20 for adjusting space between them. The adjustment component 70 includes a conjunction base 71 and an adjustment bolt 72 moving relatively to the conjunction base 71. An end of the conjunction base 71 has two resilient clamps 711, and each resilient clamp 711 has a furrow 712 surrounded at a free end thereof to engage with the respective conjunction hole 611 of the wall board 61 of each wall rack 60. An opposite end of the conjunction base 71 is formed with a screw hole 713 for the adjustment bolt 72 penetrating. An end of the adjustment bolt 72 is circularly formed with a slit 721 for engaging with a respective one of the slots 211 of the connection board 21 of each jamb 20. An opposite end of the adjustment bolt 72 is screwed to the screw hole 713 of the conjunction base 71 to make a move relative to the conjunction base 71, and the relative move is for adjusting the space between each wall rack 60 and the corresponding jamb 20.

Figure 8:
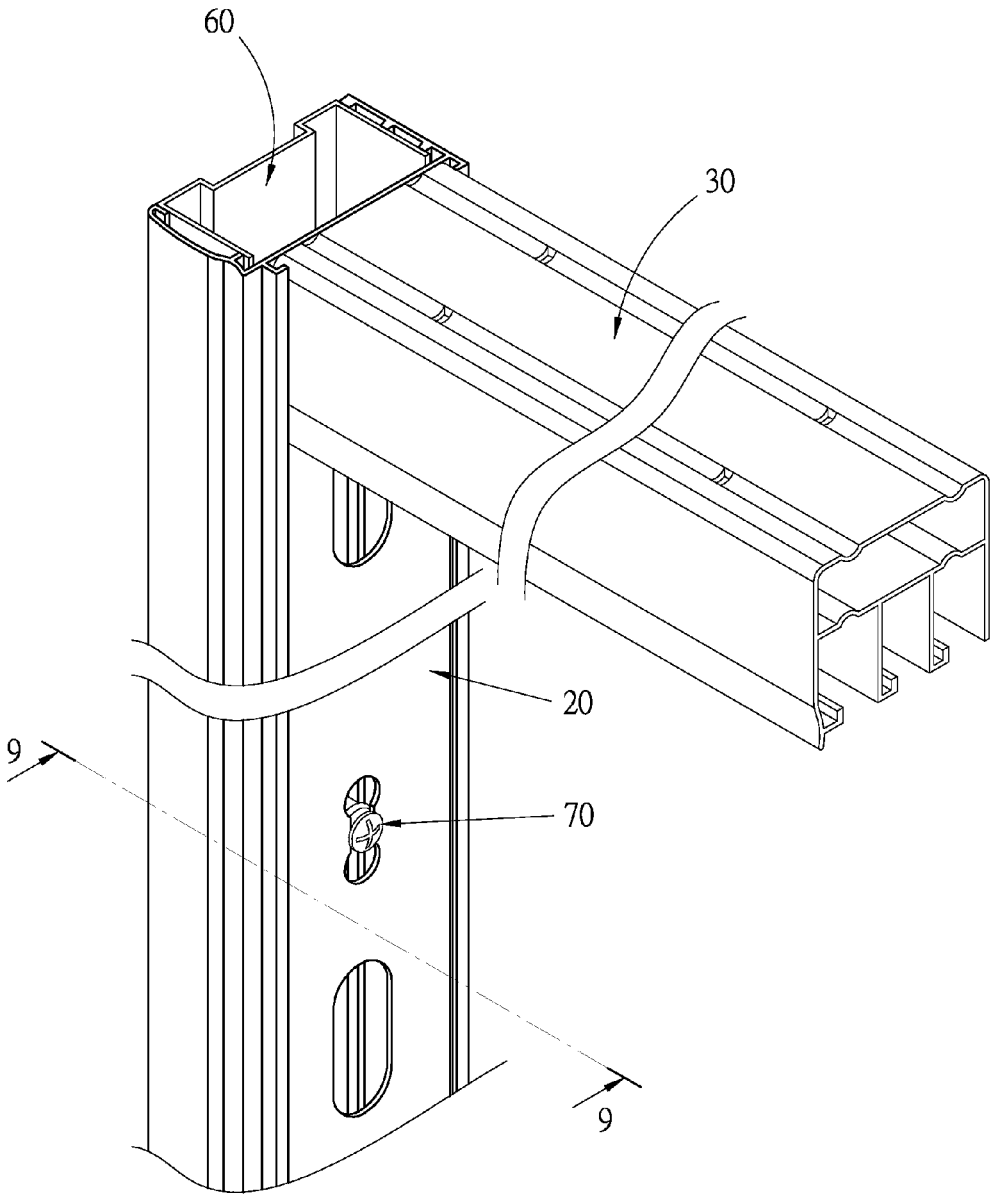
FIG. 8 is a perspective view according to FIG. 4.
Figure 9:
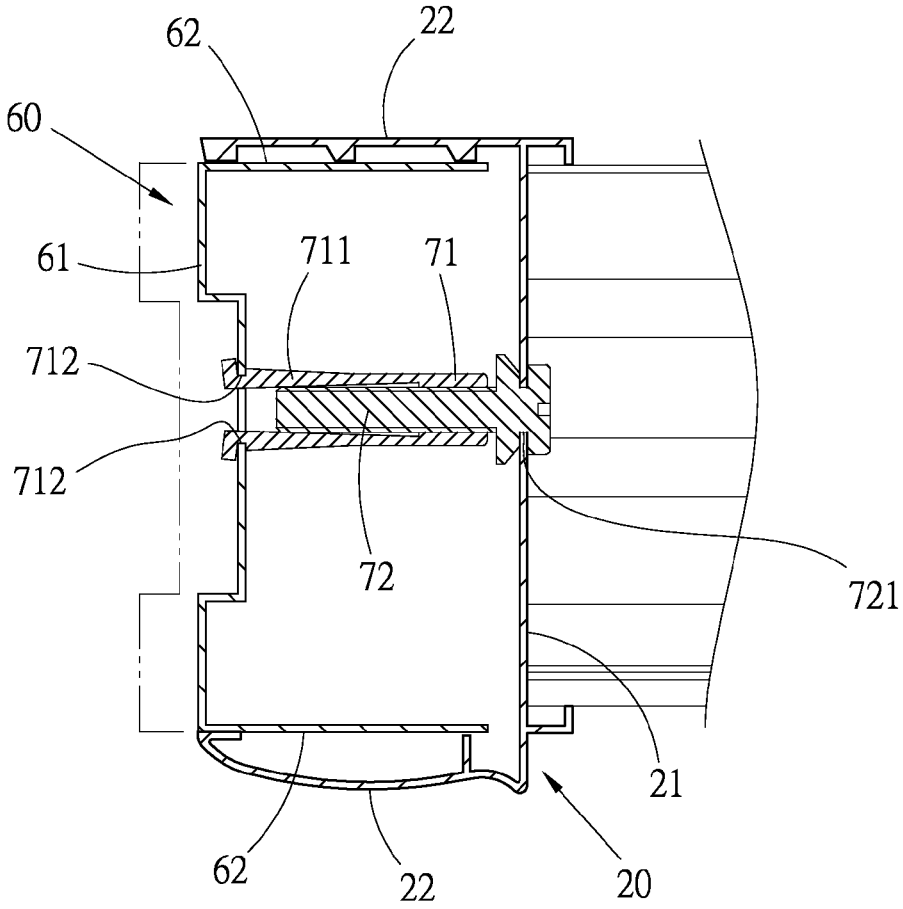
FIG. 9 is a cross-sectional profile along the line 9-9 of FIG. 8.
Figure 10:
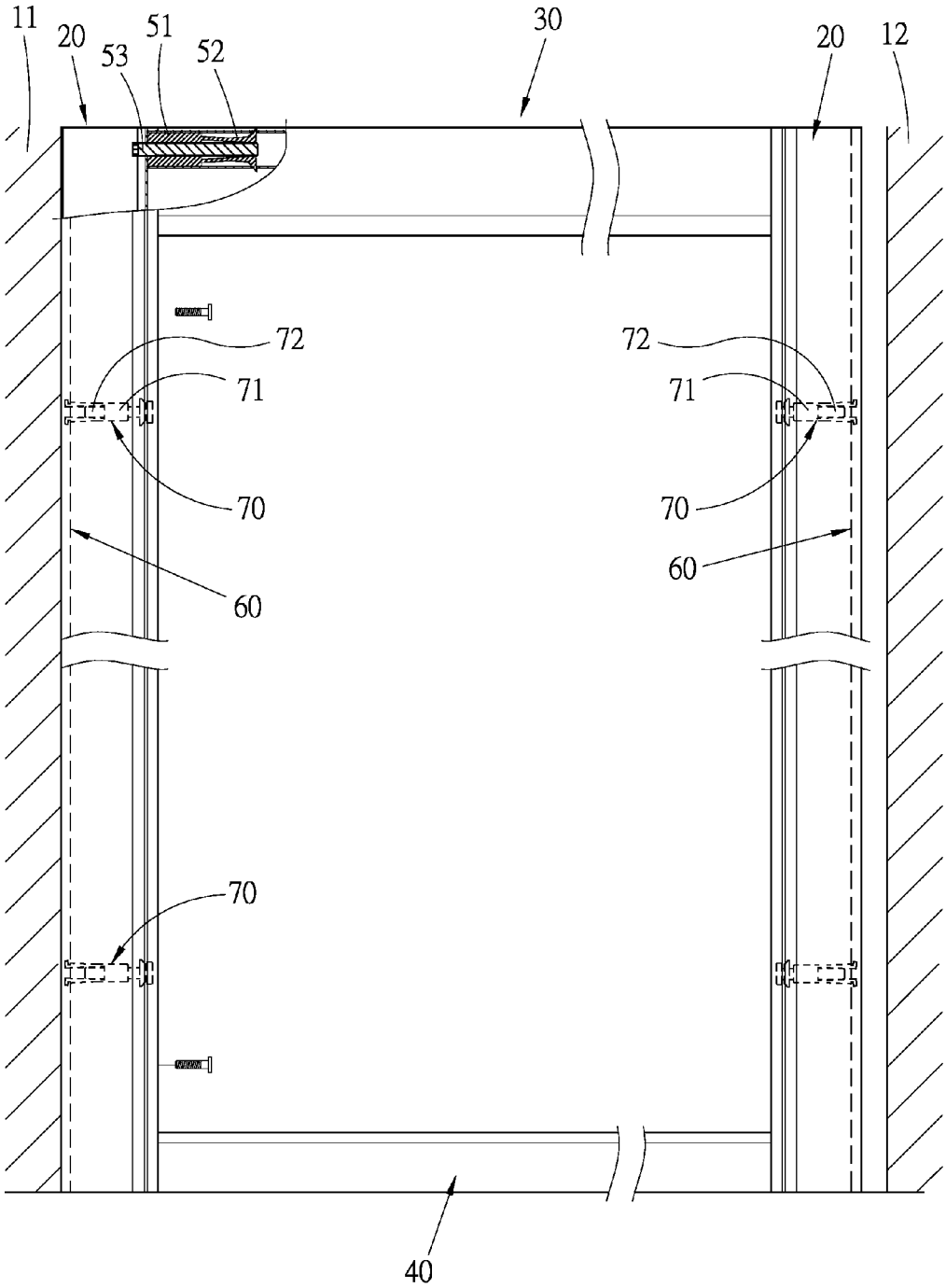
FIG. 10 is a perspective view illustrating the modular door case for bathing enclosure fitting the wall sides.

With respect to FIGS. 8 to 10, after the top frame member 30 and the bottom frame member 40 assemble to the two jambs 20, the wall racks 60 are further applied to the jambs 20 for fitting the wall sides 11, 12. As illustrated in FIG. 9, adjusting the relative move between the conjunction base 71 and the adjustment bolt 72 to push the wall rack 60 outwardly until the wall rack 60 contacts the wall side 11, as in FIG. 10. Then, screws are applied to the wall rack 60 via the respective slot 211 of each jamb 20 in order to fasten the wall rack 60 onto the wall side 11. Therefore, after accomplishing the assembly the modular door case 10, it could be further adjusted to fit the space of the shower room or the bathtub by the wall racks 60.

The modular door case for bathing enclosure according to the present invention is benefit of convenient self-assembly for common users, which means the modular door case is simple structured and quick installed, and the configuration of the modular door case still is stable and steady even it is made without professionals. In addition, there is no need to afford the budget of professionals. Absolutely the structure of the modular door case according to the present invention is also useful for the professionals.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A modular door case for bathing enclosure comprising:

two jambs, and each said jamb defining a top end and a bottom end;

a top frame member and a bottom frame member, each having an accommodating portion formed at each of two ends thereof, an upper wall and a lower wall confining the accommodating portion, and at least one pair of clasp holes respectively formed on the upper and lower walls thereof; and four fasten components, and each said fasten component having a base, at least one pair of clasp members, and at least one compelling bolt penetrating the base to get between the at least one pair of the clasp members; wherein each clasp member defines a joint end connected to the base, and a clasp protrusion disposed at a distal end thereof; each clasp member is resilient enough to sway outwards, and a space between the two clasp protrusions at the distal ends, in a normal state, is shorter than that between the two joint ends;

wherein the bases of the four fasten components respectively connect to the top and bottom ends of the two jamb, and also respectively insert into the accommodating portions of ends of the two frame members; wherein the clasp protrusion of each clasp member contacts the corresponding clasp hole of each of said top and bottom frame members in a bevel manner; the at least one respective pair of the clasp members are shoved outwardly, while the compelling bolt moves towards the distal ends of the at least one corresponding pair of the clasp members; the clasp protrusion of each clasp member clips in the corresponding clasp hole of each said top and bottom frame members, so that the specific end of the frame member is tightened to the corresponding end of the jamb via one of the fasten components, whereby ends of each said top and bottom frame members respectively fasten to the ends of the two jambs, and the modular door case for bathing enclosure is made.

2. The modular door case for bathing enclosure as claimed in claim 1, wherein the clasp protrusion of each clasp member defines an inclination face, which is for abutting against the corresponding clasp hole of the frame member.

3. The modular door case for bathing enclosure as claimed in claim 1, wherein each said jamb is approximately of a U-shaped cross-sectional profile; each said jamb includes a connection board, and two sideboards extending from two lateral sides of a face of the connection board; wherein the base of each said fasten component is fixed to an opposite face of the connection board, and the compelling bolt penetrates the base from the connection board of each said jamb and gets further between the at least one pair of the clasp members.

4. The modular door case for bathing enclosure as claimed in claim 2, wherein each said jamb is approximately of a U-shaped cross-sectional profile; each said jamb includes a connection board, and two sideboards extending from two lateral sides of a face of the connection board; wherein the base of each said fasten component is fixed to an opposite face of the connection board, and the compelling bolt penetrates the base from the connection board of each said jamb and gets further between the at least one pair of the clasp members.

5. The modular door case for bathing enclosure as claimed in claim 3, wherein the base of each said fasten component has at least one threaded hole formed between the at least one pair of the clasp members, and the compelling bolt is surrounded with threads to engage with the threaded hole so as to lead forwards and backwards.

6. The modular door case for bathing enclosure as claimed in claim 5, wherein the upper wall and the lower wall of each said top and bottom frame members are formed with at least one groove, and each of the pair of the clasp holes is arranged on the corresponding groove of each wall.

7. The modular door case for bathing enclosure as claimed in claim 4, wherein the base of each said fasten component has at least one threaded hole formed between the at least one pair of the clasp members, and the compelling bolt is surrounded with threads to engage with the threaded hole so as to lead forwards and backwards.

8. The modular door case for bathing enclosure as claimed in claim 7, wherein the upper wall and the lower wall of each said top and bottom frame members are formed with at least one groove, and each of the pair of the clasp holes is arranged on the corresponding groove of each wall.

9. The modular door case for bathing enclosure as claimed in claim 1, further including two wall racks, and each said wall rack having a wall board, and two sideboards extending from two lateral sides of a face of the wall board; wherein the two wall racks are sleeved into the two jambs respectively, and the wall board of each said wall rack and the connection board of the corresponding jamb face to each other.

10. The modular door case for bathing enclosure as claimed in claim 9, further including at least one adjustment component linking the wall board of each said wall rack and the connection board of the corresponding jamb for adjusting space between them.

11. The modular door case for bathing enclosure as claimed in claim 10, wherein the connection board of each said jamb has a plurality of slots formed along a longitudinal direction of said connection board; the wall board of each said wall rack has at least one conjunction hole along a longitudinal direction of said wall board; wherein the adjustment component includes a conjunction base and an adjustment bolt; an end of the conjunction base connects with the conjunction hole of the wall board of the corresponding wall rack; an end of the adjustment bolt links to a respective one of the slots of the connection board of the corresponding jamb, and an opposite end of the adjustment bolt links to an opposite end of the conjunction base; the adjustment bolt is capable of making a move relative to the conjunction base, whereby the relative move is for adjusting space between the wall rack and the corresponding jamb.

12. The modular door case for bathing enclosure as claimed in claim 2, further including two wall racks, and each said wall rack having a wall board, and two sideboards extending from two lateral sides of a face of the wall board; wherein the two wall racks are sleeved into the two jambs respectively, and the wall board of each said wall rack and the connection board of the corresponding jamb face to each other.

13. The modular door case for bathing enclosure as claimed in claim 12, further including at least one adjustment component linking the wall board of each said wall rack and the connection board of the corresponding jamb for adjusting a space between them.

14. The modular door case for bathing enclosure as claimed in claim 13, wherein the connection board of each said jamb has a plurality of slots formed along a longitudinal direction of said connection board; the wall board of each said wall rack has at least one conjunction hole along a longitudinal direction of said wall board; wherein the adjustment component includes a conjunction base and an adjustment bolt; an end of the conjunction base connects with the conjunction hole of the wall board of the corresponding wall rack; an end of the adjustment bolt links to a respective one of the slots of the connection board of the corresponding jamb, and an opposite end of the adjustment bolt links to an opposite end of the conjunction base; the adjustment bolt is capable of making a move relative to the conjunction base, whereby the relative move is for adjusting space between the wall rack and the corresponding jamb.

15. The modular door case for bathing enclosure as claimed in claim 3, further including two wall racks, and each said wall rack having a wall board, and two sideboards extending from two lateral sides of a face of the wall board; wherein the two wall racks are sleeved into the two jambs respectively, and the wall board of each said wall rack and the connection board of the corresponding jamb face to each other.

16. The modular door case for bathing enclosure as claimed in claim 15, further including at least one adjustment component linking the wall board of each said wall rack and the connection board of the corresponding jamb for adjusting space between them.

17. The modular door case for bathing enclosure as claimed in claim 16, wherein the connection board of each said jamb has a plurality of slots formed along a longitudinal direction of said connection board; the wall board of each said wall rack has at least one conjunction hole along a longitudinal direction of said wall board; wherein the adjustment component includes a conjunction base and an adjustment bolt; an end of the conjunction base connects with the conjunction hole of the wall board of the corresponding wall rack; an end of the adjustment bolt links to a respective one of the slots of the connection board of the corresponding jamb, and an opposite end of the adjustment bolt links to an opposite end of the conjunction base; the adjustment bolt is capable of making a move relative to the conjunction base, whereby the relative move is for adjusting space between the wall rack and the corresponding jamb.

18. The modular door case for bathing enclosure as claimed in claim 2, each said top and bottom frame members includes two pairs of the clasp holes, and each said fasten component includes two pairs of the clasp members and two of said compelling bolts; each pair of the clasp members respectively dispose at two lateral sides of a face of the base for respectively clipping in each said pair of clasp holes; and each of said compelling bolts gets between each pair of the clasp members.

19. The modular door case for bathing enclosure as claimed in claim 3, each said top and bottom frame members includes two pairs of the clasp holes, and each said fasten component includes two pairs of the clasp members and two of said compelling bolts; each pair of the clasp members respectively dispose at two lateral sides of a face of the base for respectively clipping in each said pair of clasp holes; and each of said compelling bolts gets between each pair of the clasp members.

20. The modular door case for bathing enclosure as claimed in claim 9, each said top and bottom frame members includes two pairs of the clasp holes, and each said fasten component includes two pairs of the clasp members and two of said compelling bolts; each pair of the clasp members respectively dispose at two lateral sides of a face of the base for respectively clipping in each said pair of clasp holes; and each of said compelling bolts gets between each pair of the clasp members.

* * * * *